US007999185B2

(12) United States Patent
Cases et al.

(10) Patent No.: US 7,999,185 B2
(45) Date of Patent: Aug. 16, 2011

(54) TRANSMISSION CABLE WITH SPIRALLY WRAPPED SHIELDING

(75) Inventors: Moises Cases, Austin, TX (US); Jinwoo Choi, Austin, TX (US); Bhyrav Murthy Mutnury, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 142 days.

(21) Appl. No.: 12/468,327

(22) Filed: May 19, 2009

(65) Prior Publication Data

US 2010/0294557 A1 Nov. 25, 2010

(51) Int. Cl.
*H01B 7/00* (2006.01)

(52) U.S. Cl. ..... 174/113 R; 174/117 F

(58) Field of Classification Search ..... 174/113 R, 174/117 F

See application file for complete search history.

(56) References Cited

U.S. PATENT DOCUMENTS

| | | | |
|---|---|---|---|
| 3,896,261 | A | 7/1975 | Cole |
| 4,336,420 | A | 6/1982 | Benz |
| 4,943,688 | A | 7/1990 | VanDeusen et al. |
| 5,208,426 | A | 5/1993 | Kennedy et al. |
| 5,283,390 | A | 2/1994 | Hubis et al. |
| 5,414,215 | A | 5/1995 | Dunand et al. |
| 5,416,268 | A | 5/1995 | Ellis |
| 5,872,334 | A | 2/1999 | Trazyik |
| 6,403,887 | B1 | 6/2002 | Kebabjian et al. |
| 6,444,902 | B1 | 9/2002 | Tsao et al. |
| 6,677,518 | B2 | 1/2004 | Hirakawa et al. |
| 6,803,518 | B2 | 10/2004 | Chang |
| 6,977,344 | B2 | 12/2005 | Tanaka |

*Primary Examiner* — Chau N Nguyen

(74) *Attorney, Agent, or Firm* — Yee & Associates, P.C.; Thomas E. Tyson

(57) ABSTRACT

Embodiments of the invention are directed to transmission cables, and particularly to twinax cables, for transmitting digital data and other information between components in a data processing environment. One embodiment of the invention is directed to an information transmission cable that comprises first and second signal carrying conductors of specified length, each of the signal carrying conductors being disposed to carry information signals and having a longitudinal axis. The embodiment further includes an insulating structure comprising an amount of specified dielectric insulation material, the insulating structure being positioned to surround the first and second signal carrying conductors along their respective lengths, and acting to maintain the first and second signal conductors in spaced apart parallel relationship with each other. A first drain conductor is positioned proximate to the first signal carrying conductor in spaced apart parallel relationship, and is further positioned in a first prespecified relationship with a reference line that intersects the respective longitudinal axes of the first and second signal carrying conductors, and that lies in a plane orthogonal thereto. In similar manner, a second drain conductor is positioned proximate to the second signal carrying conductor in spaced apart parallel relationship, and is further positioned in a second prespecified relationship with the reference line. Shielding material is spirally wrapped around the first and second signaling conductors, the first and second drain conductors and the insulating structure.

18 Claims, 5 Drawing Sheets

TRANSMISSION CABLE WITH SPIRALLY WRAPPED SHIELDING

BACKGROUND

1. Field

The invention disclosed and claimed herein generally pertains to a spirally wrapped twinax cable for transmitting information, such as digital data or other information produced by a data processing system. More particularly, the invention pertains to a cable of the above type that may have a length of 6-10 meters or greater.

2. Description of the Related Art

As is known by those of skill in the art, a twinax transmission cable has two conductors that are placed side by side along the length of the cable, in closely spaced relationship. The two conductors are surrounded by insulation and an outer shielding layer, and the cable may also include a DC drain conductor. Twinax cables are currently used to carry digital information signals between components of computers and data processing systems. When used for such applications, one of the conductors functions as the source conductor, and the other functions as the return conductor. Of course, during AC transmissions the roles of the two conductors switch continually.

In fabricating twinax cables, it is common practice to apply the outer shielding layer by means of spiral wrapping, in an effort to keep down fabrication costs. In spiral wrapping, a tape or thin strip of shielded foil or the like is wrapped spirally around the conductors and insulation, along the length of the cable. Each time an individual wrap is made around the conductors and insulation, a portion of the wrap is placed on top of a portion of the adjacent previous wrap. This aspect of spiral wrapping is essential, to ensure that there are no gaps in the shielding, between the edges of two adjacent wraps.

At present, twinax cables are known to have certain advantages over other transmission media, when used to transmit digital data and other information signals in a data processing environment. For example, signal attenuation due to dielectric loss is significantly less for a twinax cable than for a printed circuit board, particularly for operation at high frequencies. Notwithstanding these benefits, however, currently used designs, and in particular the use of spiral wrapping as described above, has been found to place undesirable limitations on the use or employment of conventional twinax cables.

To understand these limitations, it must be appreciated that as a result of the spiral wrapping technique, a portion or segment of a shielding wrap overlays or overlaps a segment of the previous adjacent wrap. Moreover, these overlap conditions or instances occur at fairly regular, or periodic, intervals along the length of the cable. Accordingly, a discontinuity occurs at each of the overlap conditions. Since the shielding foil also acts as a current return path when current flows in both the conductors, the return current flow through the shielding wrap does not exactly match the outgoing current through conductors. The discontinuity at an overlap is caused by an LC resonance effect, wherein the capacitance for the effect is provided by the two adjacent wrap segments of the overlap condition. Attenuation resulting from this LC effect, particularly at or near the resonance frequency, can significantly diminish signal transmission integrity and quality along the cable. Moreover, the LC resonance effect increases with cable length.

The terms "spirally wrapped" and "spirally wrapped in an overlapping maneuver", as used herein, refer to a spiral wrapping technique as described above.

Since the above deficiency of twinax cables arises from the practice of spiral wrapping, an alternate technique could be used to apply shielding to twinax cables, that avoided the creation of shielding overlaps. However, such alternate shielding techniques as are currently available typically add substantial cost to twinax cable construction, and in particular to cables having lengths of three or more meters. Accordingly, this solution is not practical for many user applications.

SUMMARY

Embodiments of the invention are directed to transmission cables, and particularly to twinax cables, for transmitting digital data and other information between components in a data processing environment. One embodiment of the invention is directed to an information transmission cable that comprises first and second signal carrying conductors of specified length, each of the signal carrying conductors being disposed to carry information signals and having a longitudinal axis. The embodiment further includes an insulating structure comprising an amount of specified dielectric insulation material, the insulating structure being positioned to surround the first and second signal carrying conductors along their respective lengths, and acting to maintain the first and second signal conductors in spaced apart parallel relationship with each other. A first drain conductor is positioned proximate to the first signal carrying conductor in spaced apart parallel relationship, and is further positioned in a first prespecified relationship with a reference line that intersects the respective longitudinal axes of the first and second signal carrying conductors, and that lies in a plane orthogonal thereto. In similar manner, a second drain conductor is positioned proximate to the second signal carrying conductor in spaced apart parallel relationship, and is further positioned in a second prespecified relationship with the reference line. Shielding material is spirally wrapped around the first and second signaling conductors, the first and second drain conductors and the insulating structure.

DETAILED DESCRIPTION

Figure 1:
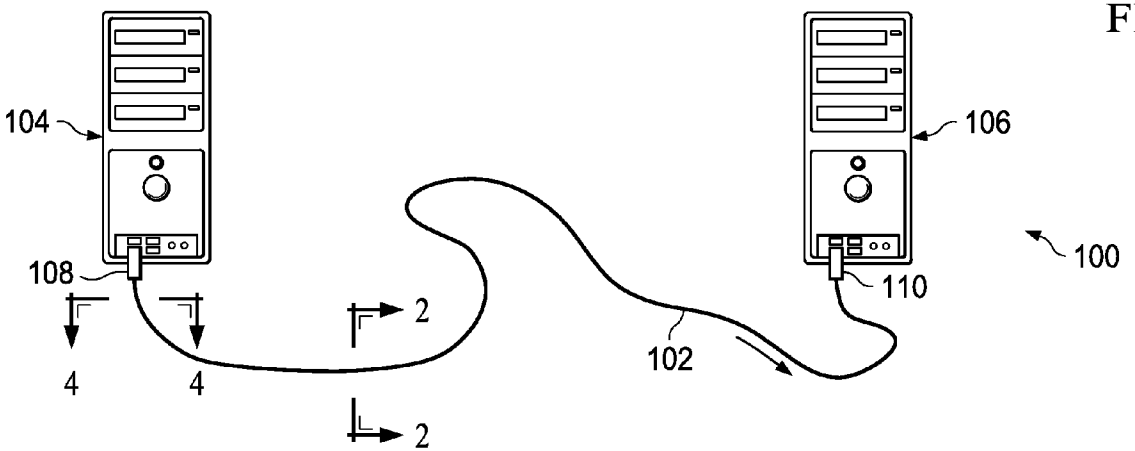
FIG. 1 is a schematic diagram depicting an embodiment of the invention deployed or provided for use in a data processing environment.

As will be appreciated by one skilled in the art, the present invention may be embodied as a system, method or computer program product. Accordingly, the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present invention may take the form of a computer program product embodied in any tangible medium of expression having computer usable program code embodied in the medium.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random axis memory (RAM), a read-only memory (ROM), an erasable programmable read-only memory (EPROM or Flash memory), an optical fiber, a portable compact disc read-only memory (CDROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer program code for carrying out operations of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present invention is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions.

These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

Referring to FIG. 1, there is shown a twinax cable 102 constructed in accordance with an embodiment of the invention, and deployed for use in a computer or data processing system environment 100. More particularly, FIG. 1 shows cable 102 coupled between two computer components 104 and 106, in order to provide a path for transmitting digital data and other information signals therebetween. Component 104 comprises a signal source or transmission component, and component 106 comprises a signal receptor or receiving component. Twinax cable 102 is intended to carry information signals of high frequencies, such as on the order of 3-20 Gigahertz or greater.

It is to be emphasized that twinax cable 102 can be used with components 104 and 106 of many different types. For example, one of such components could be a server and the other could be a database or other data storage device. More generally, components 104 and 106 could comprise different electronic modules mounted in different racks of a chassis, or even different modules mounted in different chassis. Cable 102 could also be used to connect different components of a PCI Express switching configuration.

For different applications, twinax cable 102 could be constructed to have different lengths, from 1 meter up to 10 meters or greater. FIG. 1 further shows the ends of cable 102 attached to components 104 and 106 by means of couplings 108 and 110, respectively.

Figure 2:
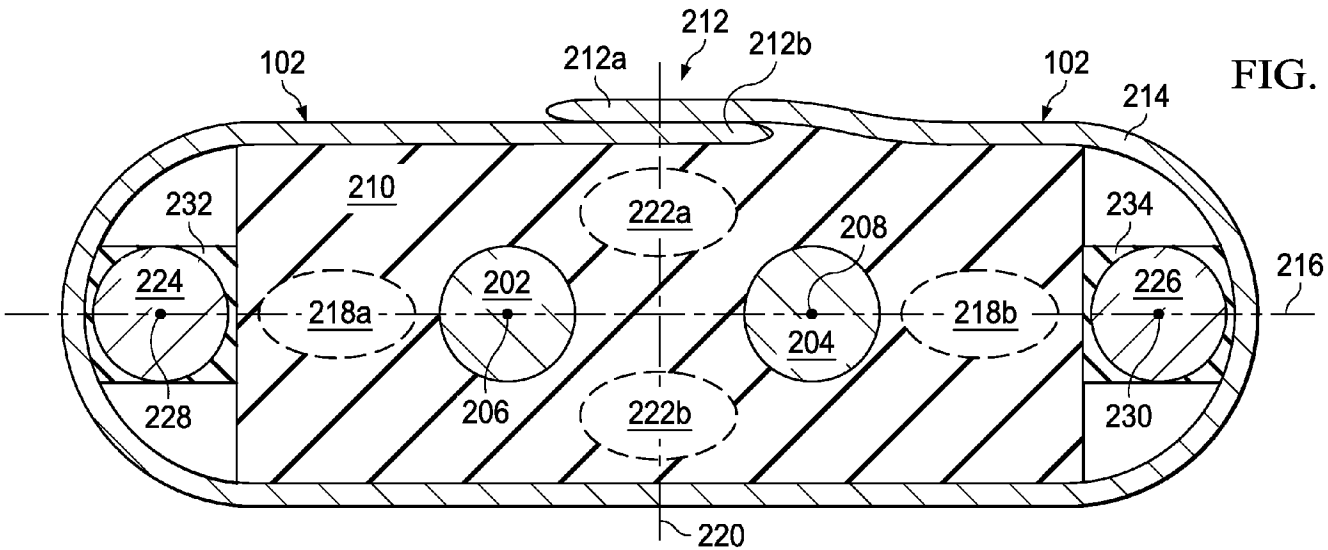
FIG. 2 is a sectional view taken along lines 2-2 of FIG. 1.

Referring to FIG. 2, there is shown a sectional view taken through cable 102. Cable 102 is provided with two signal carrying conductors 202 and 204, which extend along the entire length of cable 102, such as between couplings 108 and 110, and are usefully of circular cross section. Conductors 202 and 204 have longitudinal axes 206 and 208, respectively, wherein each longitudinal axis lies at the geometric center of its conductor and extends along the length thereof. FIG. 2 is a view taken in a plane that is orthogonal to axes 206 and 208. Cable 102 further includes an amount of dielectric insulation material 210, such as polytetraflouroethylene (PTFE) or polyethylene, which surrounds the conductors 202 and 204 along their respective lengths. The insulation material 210 forms a structure that acts to maintain signal carrying conductors 202 and 204 in spaced apart parallel relationship with each other, and at the same time allows the cable 102 to be somewhat flexible.

Because of the spiral wrapping, the sectional view of FIG. 2 depicts an overlap condition 212, as described above. More particularly, FIG. 2 shows a portion or segment 212*a* of a shielding wrap that overlaps a portion 212*b* of the previous adjacent shielding wrap. The two wrap portions 212*a* and 212*b* function as the two plates of a parallel plate capacitor, to produce a capacitance when current is flowing through cable 102. This capacitance participates in producing an LC resonance effect, as likewise described above, which causes a discontinuity in the current flowing through the return signal carrying conductor.

Referring further to FIG. 2, there is shown a reference line or axis 216 extending between the longitudinal axes 206 and 208 of respective conductors 202 and 204, and also extending between the two sides of the cable section as shown in FIG. 2. FIG. 2 depicts side regions 218*a* and 218*b*, which are generally located at or proximate to the opposing sides of the cable section. FIG. 2 additionally shows a line 220 that is orthogonal or perpendicular to reference line 216, and extends through the center of the FIG. 2 cable section. Center regions 222*a* and 222*b* are likewise generally located proximate to the center of the cable section, adjacent to spirally wrapped outer shielding layer 214.

In making the invention, it was recognized that when a twinax cable such as cable 102 is used to carry information signals, including signals at high frequencies, effects associated with the spiral wrapping of the cable result in a current distribution of the cable that has certain characteristics. In particular, it was recognized that the current distribution is comparatively strong at the sides of the cable, within and adjacent to side regions 218*a* and 218*b*. Also, the distribution is comparatively weak at the center of the cable, along line 220 and within and adjacent to the center regions 222*a* and 222*b*.

In order to prevent discontinuities in the flow of current through the return conductor, and to thereby significantly reduce the losses associated with the discontinuities as described above, FIG. 2 shows cable 102 provided with drain conductors 224 and 226, which are positioned along opposing sides of the cable and proximate to outer shielding layer 214. Each drain conductor is thus located within or near one of the regions 218*a* or 218*b*, where the current distribution in the cable is strongest. Each drain conductor extends along the entire length of cable 202 and usefully has a circular cross section. Drain conductors 224 and 226 have longitudinal axes 228 and 230, respectively, wherein each longitudinal axis lies at the geometric center of its conductor and extends along the length thereof. Drain conductors 224 and 226 are surrounded by layers of insulation material 232 and 234, respectively, which act to electrically insulate the drain conductors and hold them in place along cable 102. FIG. 2 shows the drain conductors positioned so that their respective axes 228 and 230 both intersect the reference line 216.

Conductor 224 acts as AC current return path to signal carrying conductor 202. Similarly, drain conductor 226 acts as AC current return path to signal carrying conductor 204. AC current is induced into the drain conductor by its corresponding signal carrying conductor as illustrated, for example, with FIGS. 2 and 4.

By placing the drain conductors 224 and 226 within cable 102, as described above, a uniform current return path is established longitudinally throughout the length of the cable. Accordingly, the embodiment disclosed by cable 102 ensures uniform current return at the regions of the cable where there is strong current distribution, that is, at the sides of the cable. This significantly mitigates the resonance effect in attenuation and insertion losses of the cable, even though a conventional spirally wrapped shielded foil is used to wrap both the signal carrying conductors and multiple drain conductors. The effect of shielding foil overlap at the sides of the conductors is diminished by the drain conductors, whereas foil overlap at the central region of the cable, due to the weak current distribution, will not have much impact on signal integrity.

Figure 3:
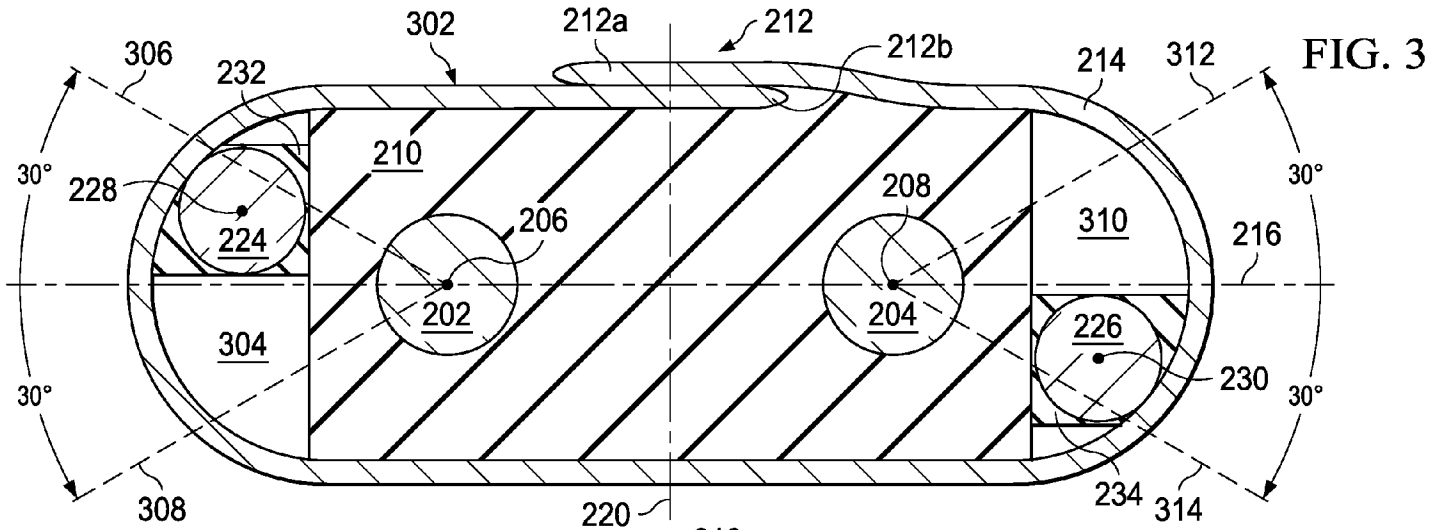
FIG. 3 is a sectional view showing a modification of the embodiment of FIGS. 1 and 2.

Referring to FIG. 3, there is shown an orthogonal section taken through a twinax cable 302 comprising a modification of cable 102. More particularly, FIG. 3 shows signal carrying conductors 202 and 204, insulating material 210 and spirally wrapped outer shielding layer 214, each respectively configured and arranged with respect to one another as described above for the cable 102. In regard to the drain conductors, however, it is recognized that the drain conductors will still be able to ensure uniform current return, even if they are located at positions other than the positions respectively disclosed therefor in FIG. 2. It is only necessary that the drain conductors be located proximate to the two sides of the cable.

In order to achieve this more general positioning of the drain conductors, FIG. 3 shows a zone 304 that is located proximate to the left side of cable 302, as viewed in FIG. 3. Zone 304 extends along the length of cable 302. It is considered that drain conductor 224 will function efficiently, as described above in connection with cable 102, as long as its longitudinal axis 228 is located within zone 304. To describe zone 304, the intersection of zone 304 with the orthogonal section of FIG. 3, in order to define an area, is considered. FIG. 3 shows that such area is bounded at least in part by boundary lines 306 and 308. Lines 306 and 308 both intersect reference line 216 at the axis 206 of signal carrying conductor 202. Line 306 is oriented to an angle of 30 degrees with respect to the reference line 216 in a clockwise direction, and line 308 is oriented to an angle of 30 degrees from reference line 216 in the opposite direction. FIG. 3 shows axis 228 of drain conductor 224 positioned to intersect the defined area, and further shows drain conductor 224 and insulation 232. Accordingly, axis 228 is located in zone 304 as required. The area of zone 304 is further bounded by insulating material 210 and layer 214.

Referring further to FIG. 3, there is shown zone 310 located proximate to the right side of cable 302, as viewed in FIG. 3, wherein zone 310 extends along the length of cable 302. Similar to zone 304, the intersection between zone 310 and the section of FIG. 3 defines an area bounded at least in part by boundary lines 312 and 314, which both intersect reference line 216 at the axis 208 of signal carrying conductor 204. Line 312 is oriented to an angle of 30 degrees with respect to the reference line 216 in a counter clockwise direction, and line 314 is oriented to an angle of 30 degrees from reference line 216 in the opposite direction. FIG. 3 shows axis 230 of drain conductor 226 positioned to intersect the area defined in connection with zone 310. Accordingly, axis 230 of drain conductor 226 is located in zone 310. Zone 310 is further bounded by insulating material 210 and layer 214.

Figure 4:
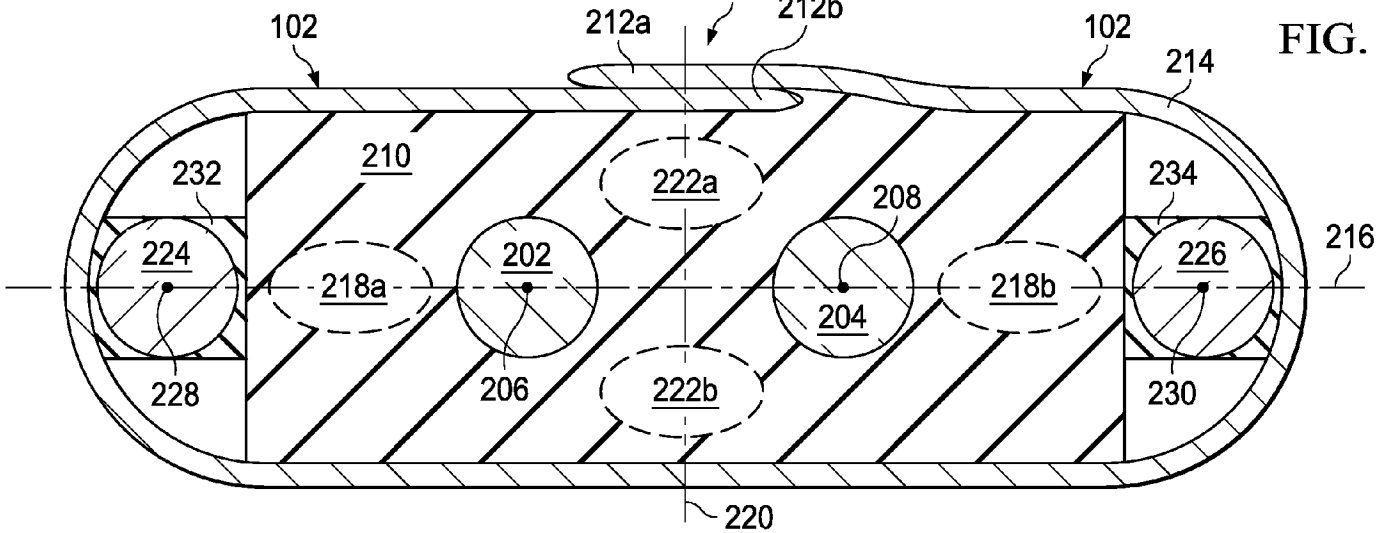
FIG. 4 is a sectional view taken along lines 4-4 of FIG. 1.

Referring to FIG. 4, there is shown a section taken through cable 102 proximate to an end thereof. FIG. 4, which is identical to FIG. 2, emphasizes that signal carrying conductor 202 is maintained in spaced apart relationship along its entire length with drain conductor 224, by insulation 210 and 232. Similarly, signal carrying conductor 204 is maintained in spaced apart relationship along its entire length with drain conductor 226, by insulation 210 and 234.

Figure 7:
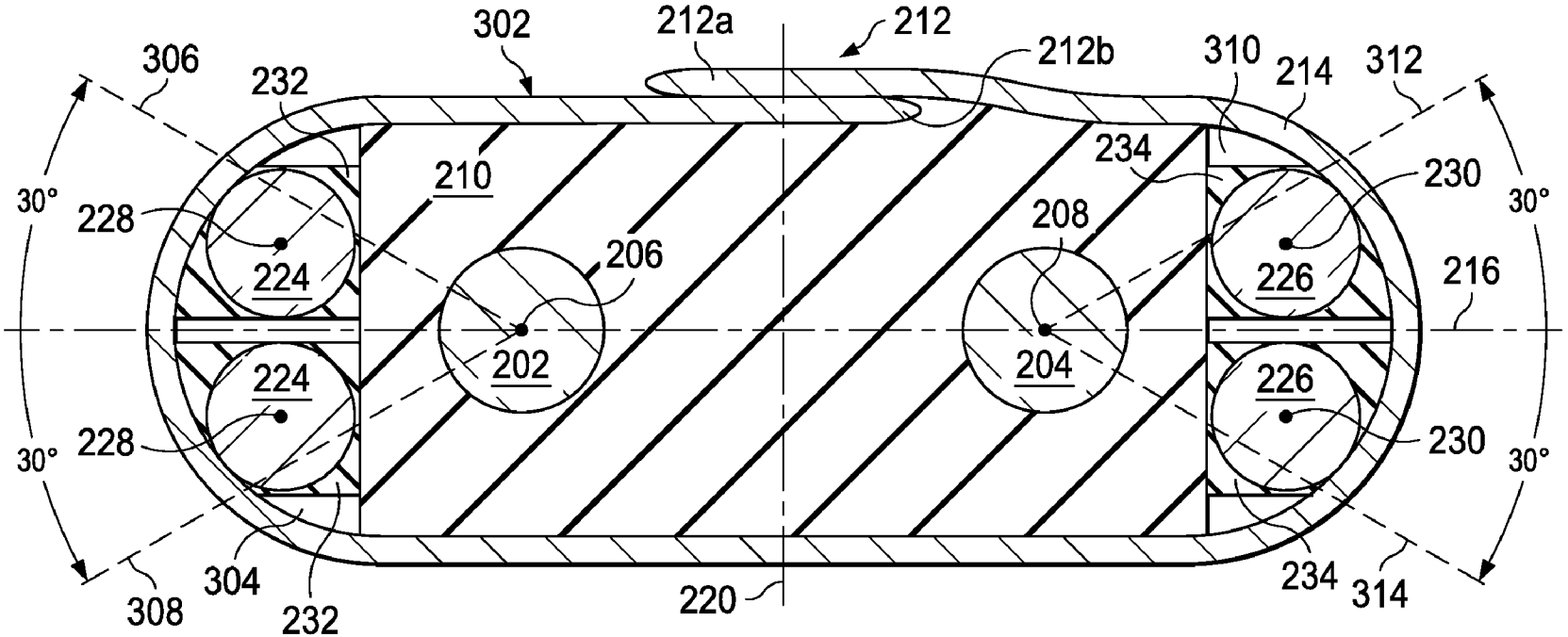
FIG. 7 is a sectional view showing the embodiment of FIG. 3 further including a plurality of drain conductors positioned in each of zone 304 and zone 310.

In other embodiments of the invention two or more drain conductors could be positioned so that their axes were each positioned in zone 304, with an equal number of drain conductors having their axes positioned in zone 310. FIG. 7 illustrates an embodiment with a plurality of drain conductors having their axes positioned in zone 304 with an equal number of drain conductors having their axes positioned in zone 310.

Figure 5:
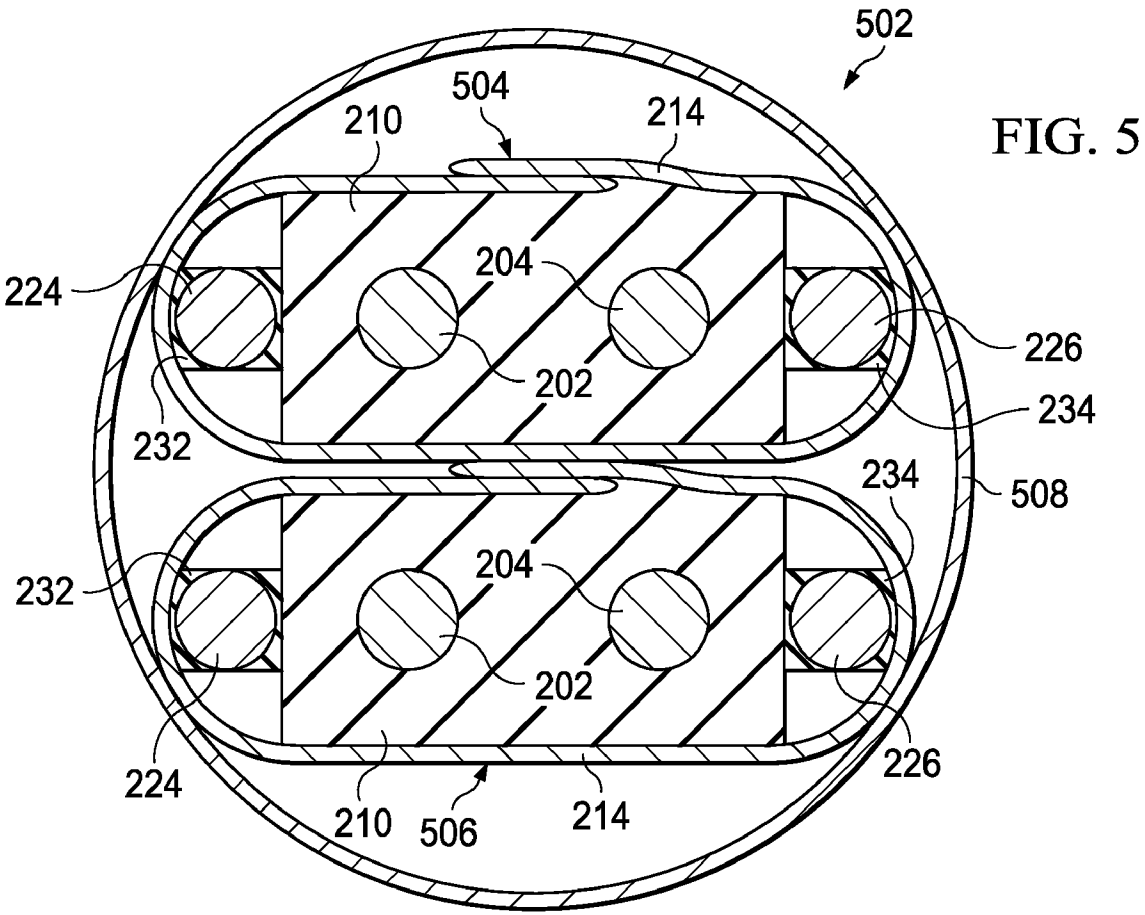
FIGS. 5 and 6 are sectional views respectively showing further modifications of the embodiment of FIGS. 1 and 2.

Referring to FIG. 5, there is shown an embodiment of the invention comprising a cable 502 adapted for multiple conductor applications. Cable 502 includes two cable units 504 and 506, wherein each cable unit comprises the same respective components as cable 102, arranged as described in connection therewith. Accordingly, each cable unit is provided with signal carrying conductors 204 and 206; insulation material 210; drain conductors 224 and 226 with respective insulation layers 232 and 234; and a spirally wrapped outer shielding layer 214.

Usefully, cable units 504 and 506 are joined together along outer surfaces of their respective shielding layers, and are collectively surrounded by a protective outer sheath 508.

Figure 6:
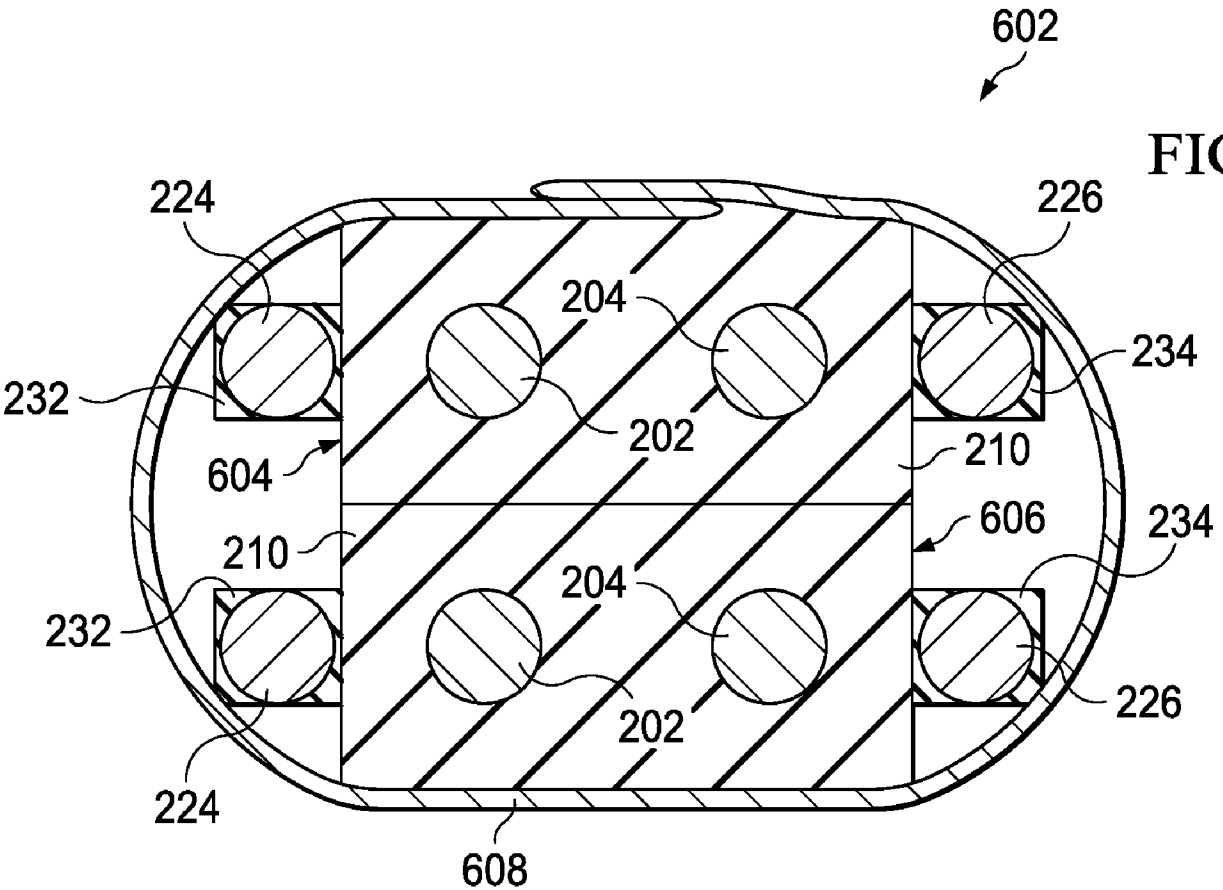

Referring to FIG. 6, there is shown an embodiment of the invention comprising a cable 602 adapted for multiple conductor applications. Cable 602 comprises two cable units 604 and 606, which are similar to and contain most of the same components as cable units 504 and 506 of FIG. 5. However, cable units 604 and 606 do not have their own individual outer shielding layers 214. Instead, cable units 604 and 606 are joined together along outer surfaces of their respective insulation structures 210, and are collectively surrounded by a spirally wrapped outer shielding layer 608.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any tangible apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random axis memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An information transmission cable comprising:

first and second signal carrying conductors of specified length, each of said signal carrying conductors disposed to carry information signals and having a longitudinal axis;

an insulating structure comprising an amount of specified dielectric insulation material, said insulating structure positioned to surround said first and second signal carrying conductors along their respective lengths, and acting to maintain said first and second signal carrying conductors in spaced apart parallel relationship with each other;

a first drain conductor positioned proximate to said first signal carrying conductor in spaced apart parallel relationship, and further positioned in a first prespecified relationship with a reference line that intersects the respective longitudinal axes of said first and second signal carrying conductors and lies in a plane orthogonal thereto;

a second drain conductor positioned proximate to said second signal carrying conductor in spaced apart parallel relationship, and further positioned in a second prespecified relationship with said reference line; and shielding material spirally wrapped around said first and second signal carrying conductors, said first and second drain conductors and said insulating structure, collectively;

wherein:

said first drain conductor is at least partially positioned in a first zone, wherein the intersection of said first zone and said orthogonal plane defines a first area in said orthogonal plane that is bounded at least in part by portions of two first boundary lines, the first boundary line and the other first boundary line, that each intersect said reference line at the axis of said first signal carrying conductor, said first boundary line being oriented to an angle of approximately 30 degrees with respect to said reference line in a clockwise direction, and the other first boundary line being oriented to an angle of approximately 30 degrees with respect to said reference line in a counter clockwise direction; and said second drain conductor is at least partially positioned in a second zone, wherein the intersection of said second zone and said orthogonal plane defines a second area in said orthogonal plane that is bounded at least in part by portions of two second boundary lines, the second boundary line and the other second boundary line, that each intersect said reference line at the axis of said second signal carrying conductor, said second boundary line being oriented to an angle of approximately 30 degrees with respect to said reference line in a clockwise direction, and the other second boundary line being oriented to an angle of approximately 30 degrees with respect to said reference line in a counter clockwise direction.

2. The cable of claim 1, wherein:

said reference line extends between first and second side regions of said cable, wherein current distribution is comparatively strong, and first and second drain conductors are positioned proximate to said first and second side regions, respectively.

3. The cable of claim 1, wherein:

said shielding material comprises a shielding tape that is spirally wrapped around said conductors and insulating structure in an overlapping manner, in order to prevent gaps between adjacent wraps of said shielding tape.

4. The cable of claim 1, wherein:

said first drain conductor has a longitudinal axis, and is positioned in said first prespecified relationship so that its axis intersects said reference lines; and said second drain conductor has a longitudinal axis, and is positioned in said second prespecified relationship so that its axis also intersects said reference line.

5. The cable of claim 1, wherein:

said first drain conductor has a longitudinal axis that intersects said first area in said orthogonal plane, and said second drain conductor has a longitudinal axis that intersects said second area in said orthogonal plane.

6. The cable of claim 1, wherein:

said cable has a length selected from a range of lengths, including an upper limit, wherein the upper limit of said range is at least 10 meters.

7. The cable of claim 1, wherein:

said first and second signal carrying conductors are disposed to carry digital information signals having a frequency selected from a range of frequencies, including an upper limit, wherein the upper limit of said range is at least 10 Gigahertz.

8. The cable of claim 1, wherein:

said first and second signal carrying conductors, said first and second drain conductors, said insulating structure and said shielding material collectively comprise one of a plurality of identical cable units, wherein said plurality of cable units are joined together to form a multiple conductor cable; and said joined cable units are collectively surrounded by a protective outer sheath.

9. The cable of claim 1, wherein:

said first and second signal carrying conductors, said first and second drain conductors, and said insulating structure collectively comprise one of a plurality of identical cable units, wherein said plurality of cable units are joined together to form a multiple conductor cable; and said joined cable units are collectively surrounded by an amount of said spirally wrapped shielding material.

10. In association with an information transmission cable having first and second signal carrying conductors of specified length, wherein the signal carrying conductors are disposed to carry information signals and each has a longitudinal axis, a method comprising the steps of:

positioning an insulating structure comprising an amount of specified dielectric insulation material to surround said first and second signal carrying conductors along their respective lengths, to maintain said first and second signal carrying conductors in spaced apart parallel relationship with each other;

identifying first and second side regions proximate to opposing sides of said cable, wherein a reference line that intersects the respective longitudinal axes of said first and second signal carrying conductors lies in a plane orthogonal thereto, and also extends between said first and second side regions;

positioning at least one first drain conductor proximate to said first side region and in spaced apart parallel relationship with said first signal carrying conductor, and further positioning said first drain conductor in a first prespecified relationship with said reference line;

positioning at least one second drain conductor proximate to second said side region and in spaced apart parallel relationship, with said second signal carrying conductor, and further positioning said second drain conductor in a second prespecified relationship with said reference line; and spirally wrapping shielding material around said first and second signal carrying conductors, said first and second drain conductors and said insulating structure, collectively;

wherein:

said first drain conductor is at least partially positioned in a first zone, wherein the intersection of said first zone and said orthogonal plane defines a first area in said orthogonal plane that is bounded at least in part by portions of two first boundary lines, the first boundary line, and the other first boundary line, that each intersect said reference line at the axis of said first signal carrying conductor, said first boundary line being oriented to an angle of approximately 30 degrees with respect to said reference line in a clockwise direction, and the other first boundary line being oriented to an angle of approximately 30 degrees with respect to said reference line in a counter clockwise direction; and said second drain conductor is at least partially positioned in a second zone, wherein the intersection of said second zone and said orthogonal plane defines a second area in said orthogonal plane that is bounded at least in part by portions of two second boundary lines, the second boundary line and the other second boundary line, that each intersect said reference line at the axis of said second signal carrying conductor, said second boundary line being oriented to an angle of approximately 30 degrees with respect to said reference line in a clockwise direction, and the other second boundary line being oriented to an angle of approximately 30 degrees with respect to said reference line in a counter clockwise direction.

11. The method of claim 10, wherein:

said shielding material comprises a shielding tape that is spirally wrapped around said conductors and insulating structure in an overlapping manner, in order to prevent gaps between adjacent wraps of said shielding tape.

12. The method of claim 10, wherein:

said first drain conductor has a longitudinal axis, and is positioned in said first prespecified relationship so that its axis intersects said reference lines; and said second drain conductor has a longitudinal axis, and is positioned in said second prespecified relationship so that its axis also intersects said reference line.

13. The method of claim 10, wherein:

a plurality of first drain conductors are positioned proximate to said first side region, and an equal number of second drain conductors are positioned proximate to said second side region.

14. An information transmission cable comprising:

first and second signal carrying conductors of specified length, each of said signal carrying conductors disposed to carry information signals and having a longitudinal axis;

a first insulating structure comprising an amount of specified dielectric insulation material, said first insulating structure positioned to surround said first and second signal carrying conductors along their respective lengths, and acting to maintain said first and second signal carrying conductors in spaced apart parallel relationship with each other;

at least one first drain conductor positioned proximate to a first side region and in spaced apart parallel relationship with said first signal carrying conductor, wherein the first side region is proximate to a first side of the cable;

wherein the at least one first drain conductor is positioned in a second insulating structure;

at least one second drain conductor positioned proximate to a second side region and in spaced apart parallel relationship with said second signal carrying conductor, wherein the second side region proximate to a second side of the cable opposing the first side;

wherein the at least one second drain conductor is positioned in a third insulating structure; and shielding material spirally wrapped around said first and second signal carrying conductors, said first and second drain conductors and said first insulating structure, said second insulating structure, and said third insulating structure, collectively.

15. The cable of claim 14, wherein:

said shielding material comprises a shielding tape that is spirally wrapped around said conductors and insulating structure in an overlapping manner, in order to prevent gaps between adjacent wraps of said shielding tape.

16. The cable of claim 14, wherein:

said first drain conductor is positioned in a first prespecified relationship with a reference line that intersects the respective longitudinal axes of said first and second signal carrying conductors and lies in a plane orthogonal thereto; and said second drain conductor is positioned in a second prespecified relationship with said reference line.

17. The cable of claim 16, wherein:

said first drain conductor has a longitudinal axis, and is positioned in said first prespecified relationship so that its axis intersects said reference lines; and said second drain conductor has a longitudinal axis, and is positioned in said second prespecified relationship so that its axis also intersects said reference line.

18. The cable of claim 14, wherein:

a plurality of first drain conductors are positioned proximate to said first side region, and an equal number of second drain conductors are positioned proximate to said second side region.

* * * * *